US005396688A

United States Patent [19]

Brown et al.

[11] Patent Number: 5,396,688

[45] Date of Patent: Mar. 14, 1995

[54] MAKING SLUB YARN ON OPEN-END MACHINE

[75] Inventors: Michael W. Brown, Charlotte; Lee K. Powell, China Grove; James C. Slagle, Jr., Mooresville, all of N.C.

[73] Assignee: Burlington Industries, Inc., Greensboro, N.C.

[21] Appl. No.: 881,263

[22] Filed: May 11, 1992

[51] Int. Cl.[6] ..... D01H 7/00; D02J 1/00; D02J 3/00

[52] U.S. Cl. ..... 26/28; 26/27; 57/404; 57/408; 57/409; 57/411; 19/97; 19/112; 19/114; 428/255; 8/478

[58] Field of Search ..... 57/404, 408, 407, 411, 57/12, 13; 19/97, 112, 114; 26/27, 28; 428/255; 8/478

[56] References Cited

U.S. PATENT DOCUMENTS

| | | | |
|---|---|---|---|
| 4,361,007 | 11/1982 | Sumner | 57/409 |
| 4,435,955 | 3/1984 | Sumner | 57/409 |
| 4,805,395 | 2/1989 | Stahlecker et al. | 57/408 |

OTHER PUBLICATIONS

"Effects of Combing-Roll Wire Design . . . " by Simpson & Murray, Textile Research Journal, Sep., 1979, pp. 506 to 512.

Technical Bulletin FRP 503 by Cotton Incorporated, 1986.

"Effect of Carding Conditions on Trash Release in Open-End Spinning" by Supanekar and Nerurkar, Jan., 1979, Textile Research Jouranl, pp. 26-27.

BSS "Basic dimensions of cones and tubes for winding textile yarns", 1969, four pages.

*Primary Examiner*—Patrick J. Ryan
*Assistant Examiner*—R. C. Weisberger
*Attorney, Agent, or Firm*—Nixon & Vanderhye

[57] ABSTRACT

Denim fabric is made from novelty cotton yarn having irregularly spaced irregularities (e.g. slubs) about one-half inch to two inches in length. The cotton novelty yarn is made by separating cotton sliver into cotton fibers, and acting on the cotton fibers with a negative wire combing roll, and then twisting the cotton fibers into the cotton novelty yarn. The negative wire combing roll has a tooth angle of about −0.01° to −15°. The novelty cotton yarn is made into a warp of about 54–100 (e.g. 54–78) ends per inch, and is ring dyed so that the core of the yarn remains white. The warp is woven with a filling yarn to produce a denim fabric with a weight of about 5 oz.–17 oz. per sq. yd. having the weave and yarn size selected so that a tight construction is provided which highlights the slubs. The fabric is subjected to surface abrasion to remove the surface of dye on the slubs to show a lighter slub than body of the fabric.

13 Claims, 2 Drawing Sheets

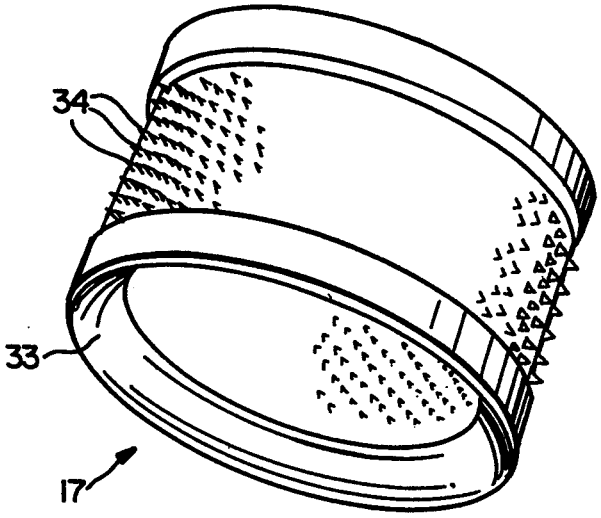
FIG. 2
FIG. 3
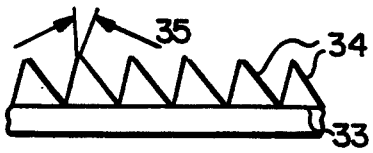
FIG. 5
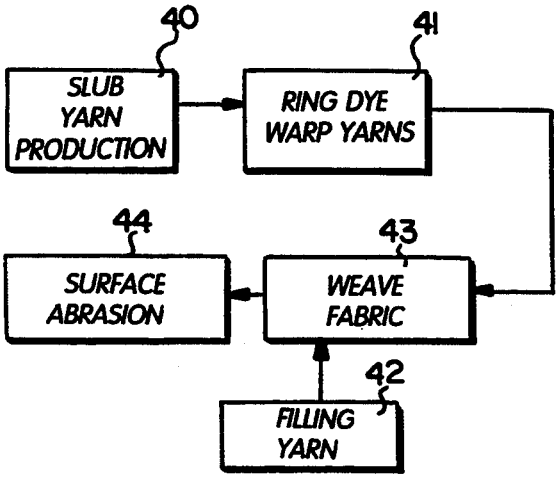

MAKING SLUB YARN ON OPEN-END MACHINE

BACKGROUND AND SUMMARY OF THE INVENTION

A wide variety of novelty yarns have been produced from synthetic fibers, cotton, and other natural fibers. However novelty yarns with short duration irregularities (yarn slubs), of about one inch to four inches in length, have not heretofore been made on open-end spinning equipment because of the very high speed of the spinning rotors (40,000–80,000 rpm), which produce yarn at speeds of 4,000–8,000 inches per minute. This requires making a feed change at 1/66th of second, which has not been physically possible. However, according to the present invention it is now possible to make short duration yarn slubs from cotton fibers on open-end spinning equipment.

According to the present invention, merely by providing a particular configuration of a combing roll, which delivers fibers to the rotors of an open-end spinning machine, it is possible to make novelty yarn. In fact, it has been found that by using conventional combing rollers which are typically employed for smooth synthetic fibers, such as polyester, the desired yarns according to the invention can be produced. Such combing rolls have negative tooth angles, and according to the invention it has been found that negative angles of about 0.01°–15° are particularly effective. Such rolls have heretofore been considered to be highly undesirable for use with cotton. For example, in an article in the Textile Research Journal by Simpson and Murray, September, 1979, pages 506 to 512, a study was made with open-end combing rolls by varying the combing wire front angle for open-end spinning of cotton between 0° and +30°. The poorest results were obtained at 0° and at +30°, providing a classic indication that negative angle combing rolls have conventionally been considered to be undesirable in the manufacture of cotton yarns.

The cotton yarn produced according to the invention has typical irregularity (slub) lengths of about one half inch—four inch, normally about one half—two inches. While such yarns have a wide variety of uses, they have been found to be particularly suited for the manufacture of denim fabric. The denim fabric produced from yarns according to the invention has a different look than denim fabrics made by other processes, which is achieved by surface abrading the fabric after construction to remove dye from the surface of the slubs, emphasizing them. The yarns according to the invention may be utilized to make a wide variety of denim fabrics, that are particularly useful when the yarn and weave of the denim are selected to provide a tight construction, which highlights the slubs.

According to a first aspect of the present invention, a method of open-end spinning cotton novelty yarn utilizing a negative wire combing roll is provided. The method comprises the following steps: (a) Separating cotton sliver into cotton fibers. (b) Acting on the cotton fibers with a negative wire combing roll so that the fibers build up on the teeth of the combing roll and slide away to produce non-uniform bundles of fibers. And, (c) twisting the cotton fibers into cotton novelty yarn, having irregularly spaced (i.e. not in a pattern) irregularities each about one-half inch to four inches in length. Steps (a) through (c) are typically practiced with a twist multiple between about 3.5 TM and and 9.5% TM, with a yarn count between about 4.5/l and 20/l. (e.g. 15/l) Ne, and produce irregularities within the range of one per every thirty inches to one per every one hundred twenty inches of yarn.

When denim fabric is to be made from the yarn according to the invention, it is utilized to construct a warp of about 54–100 ends per inch (e.g. about 54–78 ends), and the warp is dyed by ring dyeing or some other method by which the core of the yarn remains white. The warp is woven with a filling yarn to produce the denim fabric.

The filling yarn is typically selected from the group consisting essentially of cotton novelty yarn, plain open-end cotton yarn, and ring spun cotton yarn, typically having a size of about 4.5/l to 12/l Ne, and about 30–70 picks per inch. The weave may be plain (1×1), twill (2×1), warp face sateen, or 3×1 or 4×1 in left hand and right hand twill constructions. The weave is tight so as to highlight the slubs more than a loose weave.

After weaving the fabric, it is subjected to surface abrasion. Typical surface abrading techniques would be stonewashing after the fabric is formed into a garment, or sanding the fabric—prior to garment manufacture—with sandpaper having a grit of about 40–300. These surface abrading techniques remove the surface of the dye on the slub yarn to show a white or lighter slub than the body of the fabric. The fabric weight typically is about 5 oz.–17 oz. per sq. yd., and typically about 50 irregularities (slubs) are provided in a six inch square, providing a unique and desirable affect in the final denim product.

It is the primary object of the present invention to produce cotton novelty yarn having short duration yarn irregularities, and/or to produce fabrics with an unusual construction utilizing such yarn. This and other objects of the invention will become clear from an inspection of the detailed description of the invention, and from the appended claims.

BRIEF DESCRIPTION OF THE DRAWINGS

FIG. 2 is a detailed top perspective view of an exemplary combing roller utilizable in the apparatus of FIG. 1 to produce yarn according to the invention;

FIG. 3 is a side schematic illustrating the tooth construction of the roller of FIG. 2;

FIG. 5 is a schematic representation showing the major steps in the manufacture of denim fabric according to the method of the invention.

DETAILED DESCRIPTION OF THE DRAWINGS

Figure 1:
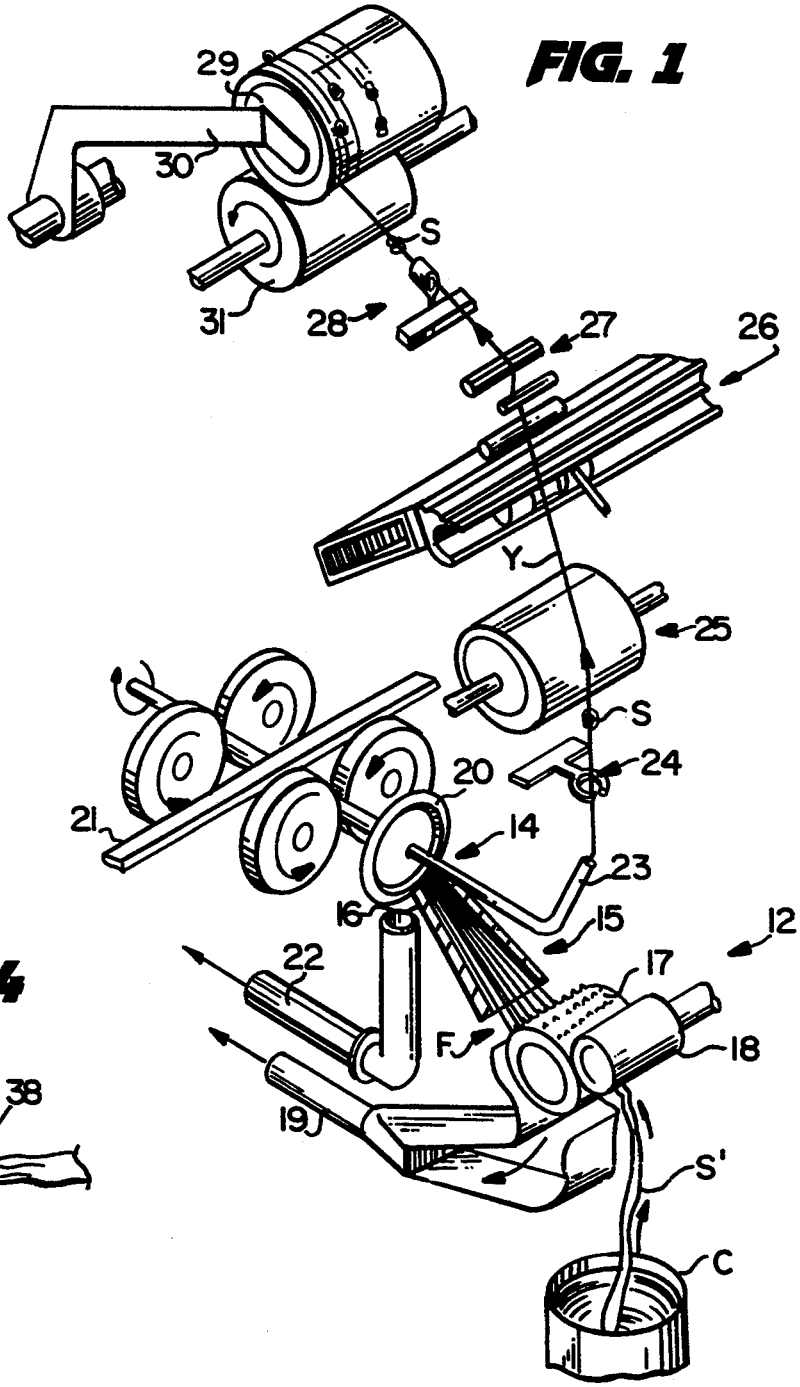
FIG. 1 is a perspective view of exemplary open-end spinning apparatus for making novelty cotton yarn according to the invention.

The apparatus of FIG. 1 is a basically conventional open-end spinning machine, such as an Autocoro, Rieter, or Spin-Flex which includes a fiber separating device 12, a fiber twisting device 14, a fiber transport 15 including a conventional fiber transport tube 16, and an opening (combing) roll 17 cooperating with a feed roll 18, the components 17, 18 feeding cotton sliver S' from a can C. The opening roll 17 separates the silver S' into the individual fibers F, these cotton fibers being passed to the fiber transport section 15 while suction is provided by suction tube 19 for trash removal. The sliver S' is overfed.

The twisting device 14 illustrated in FIG. 2 comprises a rotor 20 which is powered by a conventional rotor belt 21, with suction for the rotor chamber being provided by the suction tube 22. Yarn Y, with slubs S, produced by rotor 20 passes through yarn outlet tube 23 through a lower traverse 24 to a withdrawal roll 25. The yarn Y so formed then may pass past the "third hand" 26, compensator 27, and upper traverse 28 to the package 29 mounted on package arm 30. Take-up roll 31 cooperates with the package 29 to ensure proper take-up of the yarn Y.

Figure 4:
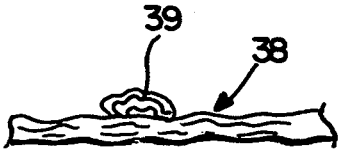
FIG. 4 is a side schematic of the denim fabric produced utilizing the yarn from FIG. 1.

All the components described heretofore in FIG. 1 are conventional for cotton yarn The yarn Y may be used for a warp, and ultimately to produce a fabric, such as the denim fabric 38 schematically illustrated in FIG. 4. The irregularities 39 (corresponding to irregularities S on the yarn Y of FIG. 1) are irregularly formed along the fabric 38 as schematically illustrated in FIG. 4. For example, there may be about fifty irregularities 39 per six inch square of denim fabric 38.

FIG. 5 schematically illustrates a method of producing denim fabric having an unusual configuration from the novelty yarn Y. Box 40 illustrates the slub yarn production, as illustrated in FIG. 1 where 100% novelty warp yarn that is ultimately produced typically has about 54–100 per inch (e.g. 54–78) ends of about 4.5/1 to 20/1 Ne, and it is dyed at block 41. The dyeing step 41 preferably is ring dyeing, or a like dyeing which causes the core of the yarn to remain white.

Filling yarn is produced as illustrated schematically at block 42 in FIG. 5. The filling yarn produced at 42, when denim fabric 38 is to be made, typically is 100% cotton yarn selected from novelty cotton yarn (the same as, or comparable to, that produced according to FIG. 1), plain open-end yarn, and ring spun yarn. Normally the cotton filling yarn has a size of about 4.5/1 to 12/1 Ne, and about 30–70 picks per inch.

As illustrated schematically at 43 in FIG. 5, a woven denim fabric 38 is produced from the warp and filling yarns on a conventional loom. A wide variety of different weaves may be utilized, such as plain weave (1×1), twill weave (2×1), warp face manufacture, except for the particular combing roll 17, which is what allows the production of slubs or irregularities S in the yarn Y. The combing roll 17 includes a body (see FIG. 2) 33, with "negative slope" teeth 34, and is conventional per se, but is conventionally designated for use with synthetic yarns, such as polyester. The teeth 34—as seen in the schematic illustration in FIG. 3—have a negative slope, making a negative angle 35. According to the invention, the angle 35 is about −0.01° to −15°. These negative angle teeth 34 cause the fibers to build up on the teeth and slide away to produce non-uniform bundles of fibers, which are subsequently twisted by fiber twisting device 14 into cotton novelty yarn Y having irregularly spaced irregularities.

In the utilization of the apparatus of FIG. 1, the method steps for producing the novelty yarn Y are typically practiced with a twist multiple between about 3.5 TM and 9.5 TM, and so that the irregularities S are produced within the range of about one per every thirty inches to one per every one hundred twenty inches. The yarn count is typically between about 4.5/1 and 20/1 (e.g. 15/1) Ne, for example desirably 5.5/1 to 9.5/1.

The slubs or irregularities S produced according to FIG. 1 vary in length from about one half inch—about four inches (typically about one half inch—two inches). The distance between the slubs can be varied from one irregularity per thirty inches to one irregularity per one hundred twenty inches. sateen weaves, or 3×1 or 4×1 left hand or right hand twill constructions. It is highly desirable to select a combination of weaves and yarn sizes that result in a tight weave construction, which highlights the slubs 39 more than looser constructions. The fabric 38 typically has a weight of about 5 oz.–17 oz. per sq. yd. One particularly desirable fabric produced according to the invention has about 67 ends per inch of about 6.4/1 warp yarn, and about 45/46 picks per inch of about 6.4/1 filling yarn, and a left hand 3×1 weave construction, with a fabric weight of about 14¾ oz. per square yard.

After construction of the fabric at 43 in FIG. 5, the fabric is subjected to surface abrasion. The purpose of the surface abrasion is to remove the surface of dye on the warp yarn to show a white or lighter slub 39 in the body of the fabric 38. This may be constructed by abrading the surface when in fabric form with fine grit sanding paper, e.g. a grit of about 40–300. Alternatively, after the fabric is made into a garment (e.g. jeans, jacket, vest, or the like), the garment may be subjected to stonewashing. The final fabric produced according to the invention has a different look than heretofore produced denims, one that is aesthetic and desirable.

It will thus be seen that according to the present invention a method of open-end spinning cotton novelty yarn, a method of producing denim fabric, and an unusual denim fabric having light colored irregularities formed irregularly (i.e. not in a pattern) along the surface thereof, are provided. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent fabrics and methods.

What is claimed is:

1. A method of open-end spinning cotton novelty yarn utilizing a negative wire combing roll, comprising the steps of:

(a) separating cotton sliver into cotton fibers;

(b) acting on the cotton fibers with a negative wire combing roll so that the fibers build up on the teeth of the combing roll and slide away to produce non-uniform bundles of fibers; and (c) twisting the cotton fibers into cotton novelty yarn, having irregularly spaced irregularities each about one-half inch to four inches in length.

2. A method as recited in claim 1 wherein steps (a)–(c) are practiced with a twist multiple between about 3.5 TM and 9.5 TM.

3. A method as recited in claim 2 wherein steps (a)–(c) are practiced with a yarn count between about 4.5/1 and 15/1 Ne.

4. A method as recited in claim 3 wherein steps (a)–(c) are practiced to produce the irregularities within the range of about one per every thirty inches to one per every one hundred twenty inches.

5. A method as recited in claim 1 wherein steps (a)–(c) are practiced with a yarn count between about 4.5/1 and 20/1 Ne.

6. A method as recited in claim 1 wherein steps (a)–(c) are practiced to produce the irregularities within the range of about one per every thirty inches to one per every one hundred twenty inches.

7. A method as recited in claim 1 wherein step (b) is practiced by acting on the fibers with a negative wire combing roll having a tooth angle of about 0.01° to −15°.

8. A method as recited in claim 1 comprising the further steps of: (d) making the novelty cotton yarn into a warp of about 54–100 ends per inch, (e) dyeing the warp, and (f) weaving the warp with filling yarn to produce a fabric.

9. A method as recited in claim 8 wherein step (e) is practiced by ring dyeing so that the core of the yarn remains white.

10. A method as recited in claim 9 wherein step (f) is practiced by using a filling yarn selected from the group consisting essentially of cotton novelty yarn, plain open-end cotton yarn, and ring spun cotton yarn, having a size of about 4.5/1 to 12/1 Ne.

11. A method as recited in claim 10 wherein steps (d)–(f) are practiced to make a denim fabric having a tight construction so as to highlight the novelty yarn irregularities, and comprising the further step (g) of surface abrading the fabric to remove the surface of dye on the irregularities to show a lighter irregularity than body of the fabric.

12. A method as recited in claim 11 wherein step (g) is practiced by sanding the surface with sandpaper having a grit between about 40–300.

13. A method as recited in claim 11 wherein step (g) is practiced by stonewashing after the fabric has been constructed into a garment.

* * * * *